US006808443B2

(12) United States Patent
Halley

(10) Patent No.: US 6,808,443 B2
(45) Date of Patent: Oct. 26, 2004

(54) PROJECTED GIMBAL POINT DRIVE

(75) Inventor: David G. Halley, Los Osos, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/877,459

(22) Filed: Jun. 7, 2001

(65) Prior Publication Data

US 2002/0002031 A1 Jan. 3, 2002

Related U.S. Application Data

(60) Provisional application No. 60/215,666, filed on Jul. 1, 2000.

(51) Int. Cl.[7] ..... B24B 1/00

(52) U.S. Cl. ..... 451/287; 451/285; 451/289

(58) Field of Search ..... 451/285, 286, 451/287, 288, 289, 397, 398, 41; 64/7; 469/120

(56) References Cited

U.S. PATENT DOCUMENTS 2,526,105 A * 10/1950 Adams ..... 64/7
3,107,505 A * 10/1963 Koss ..... 464/141
4,636,180 A * 1/1987 Runkle ..... 403/116
5,342,067 A * 8/1994 Adler et al. ..... 269/21
5,830,806 A * 11/1998 Hudson et al. ..... 451/285
6,368,189 B1 * 4/2002 Maloney et al. ..... 464/120
6,425,812 B1 * 7/2002 Pant et al. ..... 451/307
6,435,949 B1 * 8/2002 Katsuoka et al. ..... 403/57

* cited by examiner

*Primary Examiner*—Lee D. Wilson
(74) *Attorney, Agent, or Firm*—Martine & Penilla, LLP

(57) ABSTRACT

A projected gimbal point drive system is disclosed. The projected gimbal point drive system includes a spindle capable of apply a torque, and having a concave spherical surface formed on its lower portion. Further included is a wafer carrier disposed partially within the lower portion of the spindle. The wafer carrier has a convex spherical surface formed on a surface opposite the concave spherical surface of the spindle. In addition, a drive cup is included that is disposed between the spindle and the wafer carrier. The drive cup has a concave inner surface and a convex outer surface, and allows the wafer carrier to be tilted about a predefined gimbal point. In this manner, torque can be applied without affecting the gimbal action.

22 Claims, 4 Drawing Sheets

PROJECTED GIMBAL POINT DRIVE

CROSS REFERENCE TO RELATED APPLICATIONS

This application claims priority from U.S. Provisional Patent Application No. 60/215,666 filed Jul. 1, 2000 and entitled "Projected Gimbal Point Drive," which is herein incorporated by reference in its entirety.

BACKGROUND OF THE INVENTION

1. Field of the Invention

This invention relates generally to semiconductor wafer polishing, and more particularly to drive mechanisms for gimbal projection systems in a wafer polishing environment.

2. Description of the Related Art

In the fabrication of semiconductor devices, there is a need to perform Chemical Mechanical Polishing (CMP) operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric material increases.

Without planarization, fabrication of additional metallization layers becomes substantially more difficult due to the higher variations in the surface topography. In other applications, metallization line patterns are formed in the dielectric material, and then metal CMP operations are performed to remove excess metallization. Further applications include planarization of dielectric films deposited prior to the metallization process, such as dielectrics used for shallow trench isolation or for poly-metal insulation.

In the CMP process, the gimbal point of a CMP substrate carrier is a critical element. The substrate carrier must align itself to the polish surface precisely to insure uniform, planar polishing results. Many CMP substrate carriers currently available yield wafers having anomalies in planarity. The vertical height of the pivot point above the polishing surface is also important, since the greater the height, the larger the moment that is induced about the pivot point during polishing. Two pervasive problems that exist in most CMP wafer polishing apparatuses are underpolishing of the center of the wafer, and the inability to adjust the control of wafer edge exclusion as process variables change.

For example, substrate carriers used on many available CMP machines experience a phenomenon known in the art as "nose diving". During polishing, the head reacts to the polishing forces in a manner that creates a sizable moment, which is directly influenced by the height of the gimbal point, mentioned above. This moment causes a pressure differential along the direction of motion of the head. The result of the pressure differential is the formation of a standing wave of the chemical slurry that interfaces the wafer and the abrasive surface. This causes the edge of the wafer, which is at the leading edge of the substrate carrier, to become polished faster and to a greater degree than the center of the wafer.

The removal of material on the wafer is related to the chemical action of the slurry. As slurry is inducted between the wafer and the abrasive pad and reacts, the chemicals responsible for removal of the wafer material gradually become exhausted. Thus, the removal of wafer material further from the leading edge of the substrate carrier (i.e., the center of the wafer) experiences a diminished rate of chemical removal when compared with the chemical action at the leading edge of the substrate carrier (i.e., the edge of the wafer), due to the diminished activity of the chemicals in the slurry when it reaches the center of the wafer.

Apart from attempts to reshape the crown of the substrate carrier, other attempts have been made to improve the aforementioned problem concerning "nose diving". In a prior art substrate carrier that gimbals through a single bearing at the top of the substrate carrier, sizable moments are generated because the effective gimbal point of the substrate carrier exists at a significant, non-zero distance from the surface of the polishing pad. Thus, the frictional forces, acting at the surface of the polishing pad, act through this distance to create the undesirable moments.

Further, the need for torsional drives that connect the gimbal to the driving spindle have proved unsuccessful in reducing the "nose diving" effect. In particular, using a single, or other direct drive means causes a force moment above the wafer that again causes "nose diving." Moreover, drive pins are a source of backlash, since a pin needs to be free in a hole to allow pivoting.

In view of the foregoing, there is a need for a gimbal based torsion drive that is capable of driving a wafer without causing the wafer edges to dig into the on coming polishing pad. The drive should allow the wafer to be driven rotationally yet still pivot to allow for non-alignment of the rotational axis with the contact surface of the wafer being driven.

SUMMARY OF THE INVENTION

Broadly speaking, the present invention fills these needs by providing a drive mechanism that permits torque and axial force to be transmitted to a wafer being polished, not withstanding that the plane of the wafer might not be exactly perpendicular to the axis of rotation of the driving spindle. Thus, the drive mechanism allows the wafer to tilt about a gimbal point located on the surface of the wafer. In one embodiment, a projected gimbal point drive system is disclosed. The projected gimbal point drive system includes a spindle capable of applying a torque, and further having a concave spherical surface formed on its lower portion. Also included is a wafer carrier disposed partially within the lower portion of the spindle. The wafer carrier has a convex spherical surface formed on a surface opposite the concave spherical surface of the spindle. In addition, a drive cup is included that is disposed between the spindle and the wafer carrier. The drive cup has a concave inner surface and a convex outer surface, and allows the wafer carrier to be tilted about a predefined gimbal point. The gimbal point can be located on an interface between a polishing pad and a surface of a wafer held by the wafer carrier. Further, the gimbal point can be intentionally located above ("nose diving") or below (skiing") the interface between a polishing pad and a surface of a wafer held by the wafer carrier if desired.

In another embodiment, a projected gimbal point drive cup is disclosed. The projected gimbal point drive cup includes a first set of elongated slots located in a convex outer surface of the drive cup, and a second set of elongated slots located in a concave inner surface of the drive cup. The drive cup allows a wafer carrier to be tilted about a predefined gimbal point. A first set of drive keys extending out of a concave spherical surface of a spindle can be used to extend into the first set of slots in the drive cup. Similarly, a second set of drive keys extending out of a convex spherical surface of the wafer carrier can extend into the second set of slots of the drive cup. Optionally, the first set of slots can comprise two elongated slots, which are separated by about 180 degrees around the circumference of the drive cup. Similarly, the second set of slots can comprise two elongated slots, which also are separated by about 180 degrees around the circumference of the drive cup. Further, the first set of slots can be located about ninety degrees around an axis of symmetry of the drive cup from the second set of elongated slots.

A method for driving a projected gimbal point system is disclosed in a further embodiment of the present invention. A spindle is provided that is capable of apply a torque. The spindle includes a concave spherical surface formed on a lower portion of the spindle. Also, a wafer carrier is disposed partially within the lower portion of the spindle. The wafer carrier includes a convex spherical surface formed on a surface opposite the concave spherical surface of the spindle. The spindle is then coupled to the wafer carrier using a drive cup disposed between the spindle and the wafer carrier. As above, the drive cup includes a concave inner surface and a convex outer surface, and allows the wafer carrier to be tilted about a predefined gimbal point. The gimbal point can be located on an interface between a polishing pad and a surface of a wafer held by the wafer carrier. Optionally, the gimbal point can be intentionally located above or below the interface between a polishing pad and a surface of the wafer held by the wafer carrier as desired.

Advantageously, the embodiments of the present invention can be configured such that the spherical shape and concentricity of the surface of the lower part of the drive spindle and surface of the wafer carrier assure that the wafer can tilt only about an axis that lies in the plane of the wafer-pad interface. If the axis about which the wafer tilts lies above or below the wafer-pad interface, forces are generated that push one sector of the wafer into the polishing pad more strongly than the diametrically opposite sector of the wafer is pushed, resulting in undesirable effects. The embodiments of the present invention allow these forces to be reduced, eliminated, or employed deliberately in a controlled manner to produce a desired result. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a projected gimbal point drive. To this end, the present invention provides a drive isolation cup that permits torque and axial force to be transmitted to a wafer being polished, not withstanding that the plane of the wafer might not be exactly perpendicular to the axis of rotation of the driving spindle. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
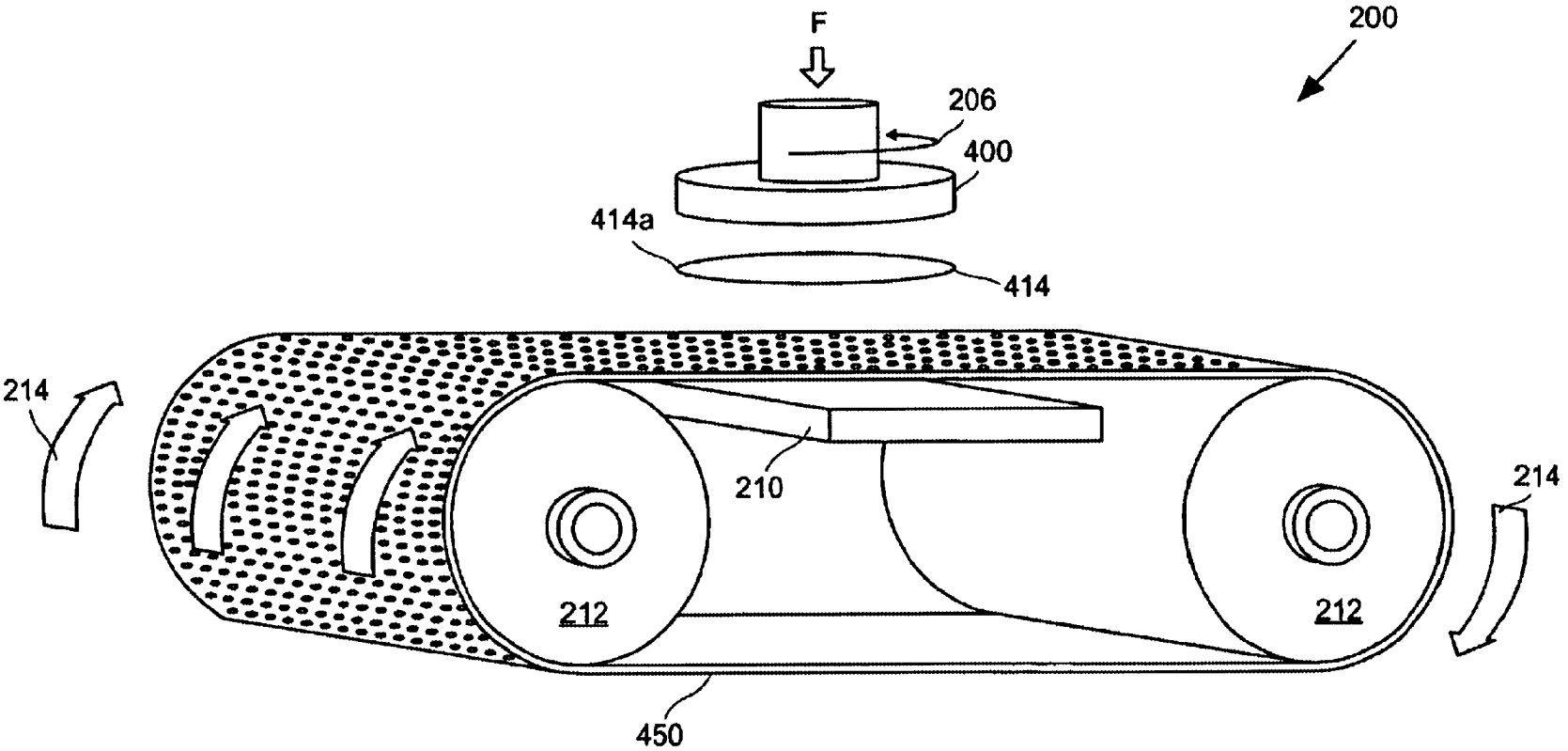
FIG. 1 is a simplified schematic diagram of an exemplary chemical mechanical planarization (CMP) system in accordance with one embodiment of the present invention.

FIG. 1 is a simplified schematic diagram of an exemplary chemical mechanical planarization (CMP) system in accordance with one embodiment of the present invention. As shown in FIG. 1, CMP system 200 is a fixed abrasive CMP system, so designated because the preparation surface is an endless fixed abrasive material belt 450. Fixed abrasive material belt 450 is mounted on two drums 212, which drive the belt in a rotational motion in the direction indicated by arrows 214.

Wafer 414 is mounted on wafer carrier mechanism 400, which is rotated in direction 206. To carry out a planarization process, rotating wafer 414 is applied against the rotating fixed abrasive material belt 450 with a force F. As is well known to those skilled in the art, the force F may be varied to meet the demands of particular planarization processes. Platen 210, which is disposed below fixed abrasive material belt 450, stabilizes the belt and provides a solid surface onto which wafer 414 may be applied. Using the fixed abrasive material belt 450, the topographic features of wafer 414 activate the micro-replicated features of fixed abrasive material belt 450. Wafer carrier mechanism 400 is configured to prevent significant activation of the micro-replicated features of fixed abrasive material belt 450 by leading edge 414*a* of wafer 414, as will explained in more detail below. Thus, when the topographic features of wafer 414 are planarized, there are no remaining topographic features to activate the micro-replicated features of fixed abrasive material belt 450. As a result, the material removal rate slows by one or more orders of magnitude, thereby providing the CMP process with an automatic stopping characteristic referred to herein as "self-stopping."

Figure 2:
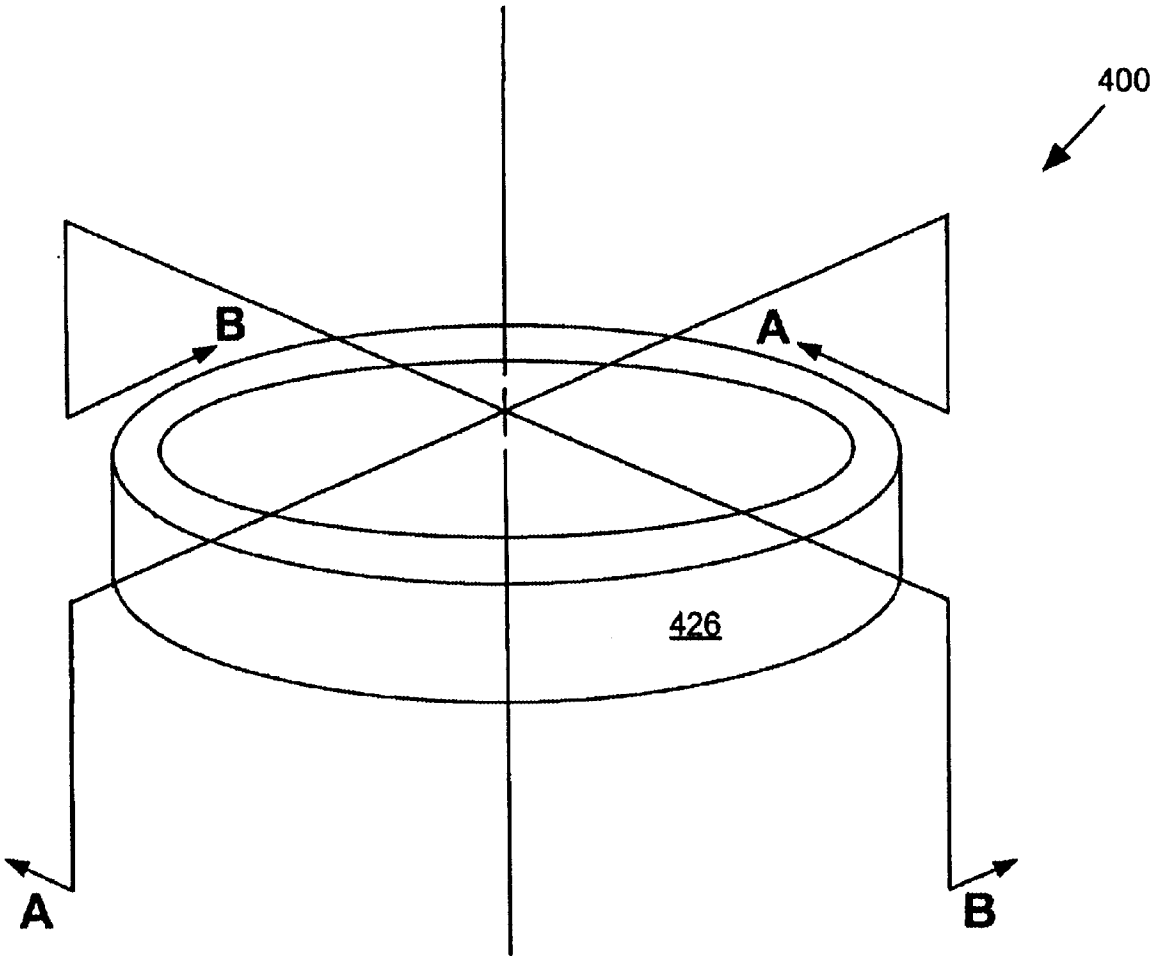
FIG. 2 is an illustration showing a wafer carrier mechanism having a projected gimbal point drive, in accordance with an embodiment of the present invention.

FIG. 2 is an illustration showing a wafer carrier mechanism 400 having a projected gimbal point drive, in accordance with an embodiment of the present invention. In one embodiment, the projected gimbal point drive is a drive isolation cup, disposed within the lower portion 426 of a spindle, which permits torque and axial force to be transmitted to a wafer being polished. The drive isolation cup of the present invention is capable of transmitting he torque and axial force to the wafer not withstanding that the plane of the wafer might not be exactly perpendicular to the axis of rotation of the driving spindle, and by extension, the wafer carrier.

As discussed in greater detail subsequently, the geometry of the drive isolation cup is such that the wafer may tilt in any direction about a gimbal point located on the interface between the polishing pad and the surface of the wafer that is being polished. In this manner, embodiments of the present invention are capable of avoiding undesirable forces being applied perpendicular to the wafer, which are caused by locating the gimbal point in other locations.

Figure 3:
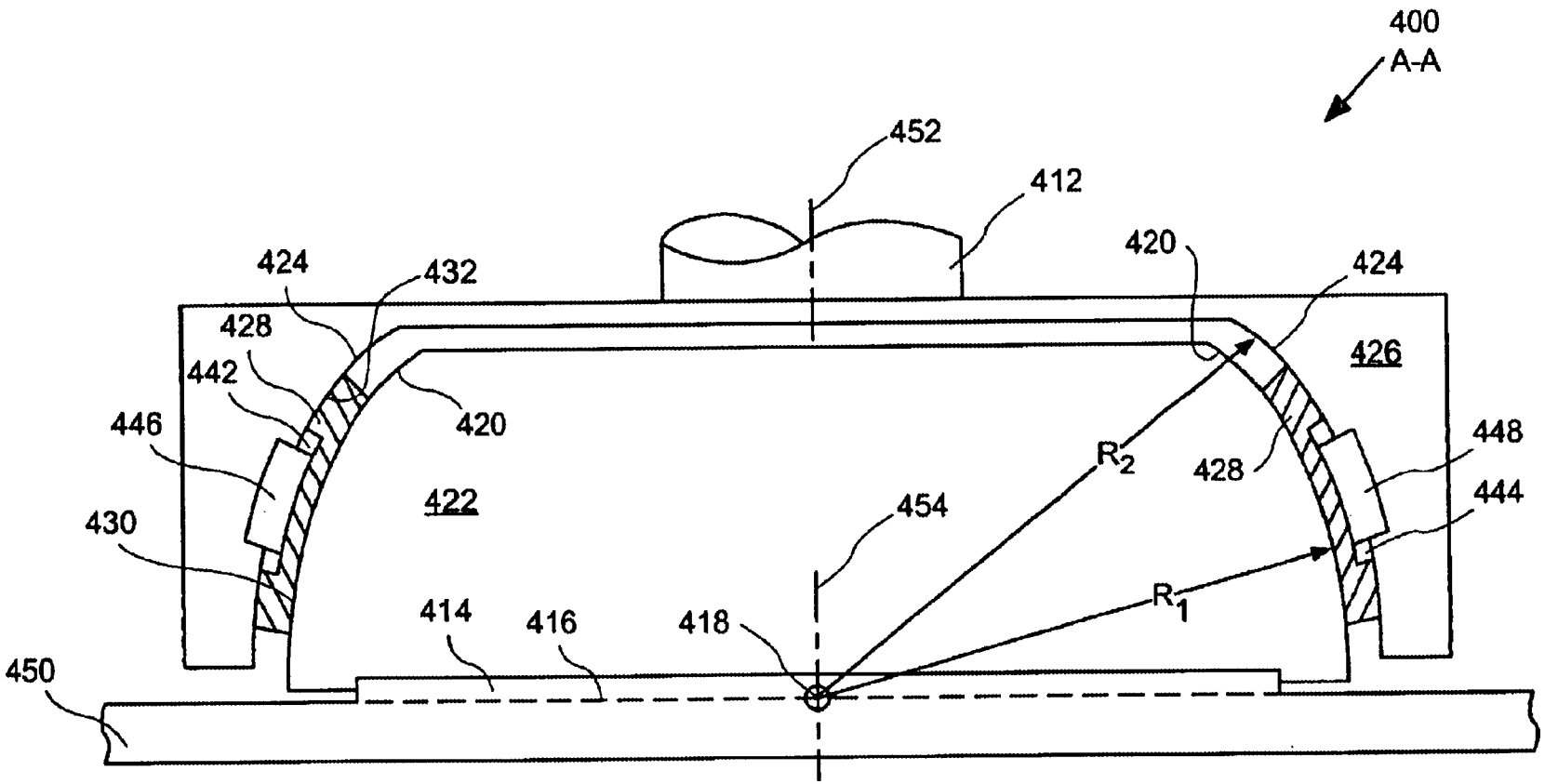
FIG. 3 is side elevation cross sectional view A—A through the wafer carrier mechanism intersecting along an axis of rotation of the spindle.

FIG. 3 is side elevation cross sectional view A—A through the wafer carrier mechanism 400 intersecting along an axis of rotation of the spindle. It should be noted that the axis of rotation of the driving spindle shown in FIG. 3 is an ideal situation wherein the axis of rotation is coinciding with a line perpendicular to the wafer, through the center of the wafer.

The wafer carrier mechanism 400 includes a lower part 426 of the spindle 412 coupled to a wafer carrier 422 via drive cup 428. Drive keys 446 and 448 are used to transmit torque, as are drive keys 438 and 440, discussed subsequently with respect to FIG. 4. A polishing belt 450, disposed below the wafer carrier 422, is used to polish the surface of the wafer 414 during a CMP process. In operation, the drive spindle 412 applies a torque and a downward force to push the lower surface of the wafer 414 against the polishing pad 450.

In spite of efforts to achieve perfect alignment, a line 454 perpendicular to the wafer might deviate from being exactly parallel to the axis of rotation 452 of the spindle 412. The embodiments of the present invention advantageously accommodate this misalignment. To this end, the embodiments of the present invention locate the wafer 414 at such an elevation that any tilting of the wafer 414 from a position perpendicular to the spindle axis 452 occurs about a line that lies on the wafer-pad interface 416. In addition, some embodiments can locate the wafer 414 at such an elevation that any tilting of the wafer 414 from a position perpendicular to the spindle axis 452 occurs about a line that lies parallel to the wafer-pad interface 416, but spaced above or below the interface by a pre-selected distance.

As shown in FIG. 3, a convex spherical surface 420 is formed on the wafer carrier 422. The convex spherical surface 420 has a radius $R_1$ from a point 418 at the center of the wafer 414 on the wafer-pad interface 416. From the same point 418, a concave spherical surface 424 of radius $R_2$ is formed on a lower part 426 of the driving spindle 412. It should be noted that the radius $R_1$ and radius $R_2$ can alternatively extend from a point at the center of the wafer 414 above the wafer-pad interface 416, or below the wafer-pad interface 416, depending on design requirements.

Disposed between the convex spherical surface 420 of the wafer carrier 422 and the concave spherical surface 424 of the lower part 426 of the drive spindle 412 is a drive cup 428. The drive cup 428 is generally ring-shaped and has a concave inner spherical surface 430 of radius $R_1$ and a convex outer spherical surface 432 of radius $R_2$. Formed in the convex outer spherical surface 432 of the drive cup 428 are two vertically elongated slots 442 and 444, which are separated by about 180 degrees around the circumference of the drive cup 428. Two drive keys 446 and 448 extend out of the concave spherical surface 424 of the lower portion 426 of the drive spindle 412. The drive keys 446 and 448 extend into the slots 442 and 444 of the drive cup 428, respectively, to transmit torque. The slots 442 and 444 are longer than the drive keys 446 and 448 to accommodate tilting movement between the lower portion 426 of the drive spindle 412 and the drive cup 428.

Figure 4:
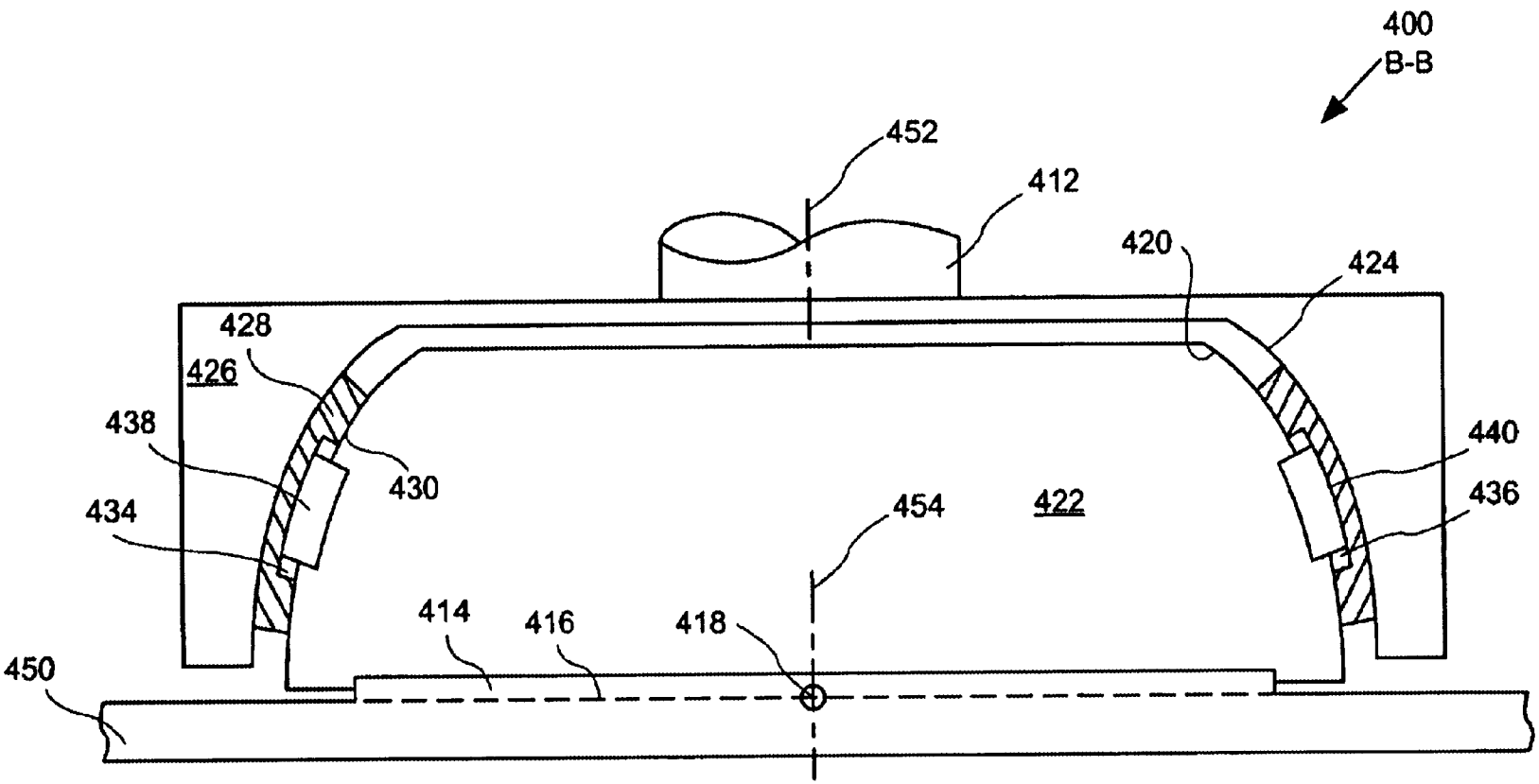
FIG. 4 is side elevation cross sectional view B—B through the wafer carrier mechanism intersecting along an axis of rotation of the spindle.

FIG. 4 is side elevation cross sectional view B—B through the wafer carrier mechanism 400 intersecting along an axis of rotation of the spindle. As in FIG. 3, it should be noted that the axis of rotation of the driving spindle shown in FIG. 4 is an ideal situation wherein the axis of rotation is coinciding with a line perpendicular to the wafer, through the center of the wafer.

As shown in FIG. 4, two vertically elongated slots 434 and 436 are formed in the concave inner spherical surface 430 of the drive cup 428. Similar to slots 442 and 444, slots 434 and 436 are separated by about 180 degrees around the circumference of the drive cup 428. Two drive keys 438 and 440 extend out of the convex spherical surface 420 of the wafer carrier 422. The drive keys 438 and 440 extend into the elongated slots 434 and 436 of the drive cup 428, respectively, to transmit torque. Further, the drive keys 438 and 440 are spaced about 90 degrees from the drive keys 446 and 448 around the axis of symmetry of the drive cup 428. As above, the slots 434 and 436 are longer than the drive keys 438 and 440 to accommodate tilting movement between the wafer carrier 422 and the drive cup 428.

Advantageously, the embodiments of the present invention can be configured such that the spherical shape and concentricity of the surface 420 of the lower part 426 of the drive spindle 412 and surface 424 of the wafer carrier assure that the wafer 414 can tilt only about an axis that lies in the plane of the wafer-pad interface 416. If the axis about which the wafer 414 tilts lies above or below the wafer-pad interface 416, forces are generated that push one sector of the wafer 414 into the polishing pad 450 more strongly than the diametrically opposite sector of the wafer 414 is pushed, resulting in undesirable effects. The embodiments of the present invention allow these forces to be reduced, eliminated, or employed deliberately in a controlled manner to produce a desired result.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A projected gimbal point drive system for holding a wafer, comprising:

a spindle capable of applying a torque, the spindle having a concave spherical surface formed on a lower portion of the spindle;

a wafer carrier disposed at least partially within the lower portion of the spindle, the wafer carrier having a convex spherical surface formed on a surface opposite the concave spherical surface of the spindle; and a drive cup disposed between the spindle and the wafer carrier, the drive cup having a concave inner surface and a convex outer surface, wherein the drive cup allows the wafer carrier that holds a wafer to be tilted about a predefined gimbal point.

2. A projected gimbal point drive system for holding a wafer as recited in claim 1, wherein the gimbal point is located on an interface between a polishing pad and a surface of a wafer held by the wafer carrier.

3. A projected gimbal point drive system for holding a wafer as recited in claim 1, wherein the gimbal point is located below an interface between a polishing pad and a surface of a wafer held by the wafer carrier.

4. A projected gimbal point drive system for holding a wafer as recited in claim 1, wherein the gimbal point is located above an interface between a polishing pad and a surface of a wafer held by the wafer carrier.

5. A projected gimbal point drive system for holding a wafer as recited in claim 1, wherein the drive cup includes a first set of elongated slots located in the convex outer surface of the drive cup.

6. A projected gimbal point drive system for holding a wafer as recited in claim 5, further comprising a first set of drive keys extending out of the concave spherical surface of the spindle.

7. A projected gimbal point drive system for holding a wafer as recited in claim 6, wherein the first set of drive keys extend into the first set of slots in the drive cup.

8. A projected gimbal point drive system for holding a wafer as recited in claim 1, wherein the drive cup includes a second set of elongated slots located in the concave inner surface of the drive cup.

9. A projected gimbal point drive system for holding a wafer as recited in claim 8, further comprising a second set of drive keys extending out of the convex spherical surface of the wafer carrier.

10. A projected gimbal point drive system for holding a wafer as recited in claim 9, wherein the second set of drive keys extend into the second set of drive slots of the drive cup.

11. A projected gimbal point drive cup, comprising:

a wafer carrier for holding a wafer;

a first set of elongated slots located in a convex outer surface of the drive cup; and a second set of elongated slots located in a concave inner surface of the drive cup, wherein the drive cup allows the wafer carrier that holds the wafer to be tilted about a predefined gimbal point when applied onto a polishing surface.

12. A projected gimbal point drive cup as recited in claim 11, wherein a first set of drive keys extending out of a concave spherical surface of a spindle extend into the first set of slots in the drive cup.

13. A projected gimbal point drive cup as recited in claim 12, wherein a second set of drive keys extending out of a convex spherical surface of the wafer carrier extend into the second set of slots of the drive cup.

14. A projected gimbal point drive cup as recited in claim 13, wherein the first set of slots comprises two elongated slots.

15. A projected gimbal point drive cup as recited in claim 14, wherein the two elongated slots of the first set of slots are separated by about 180 degrees around the circumference of the drive cup.

16. A projected gimbal point drive cup as recited in claim 15, wherein the second set of slots comprises two elongated slots.

17. A projected gimbal point drive cup as recited in claim 16, wherein the two elongated slots of the second set of slots are separated by about 180 degrees around the circumference of the drive cup.

18. A projected gimbal point drive cup as recited in claim 17, wherein the first set of slots are located about ninety degrees around an axis of symmetry of the drive cup from the second set of elongated slots.

19. A method for driving a projected gimbal point system, comprising the operations of:

providing a spindle capable of applying a torque, the spindle having a concave spherical surface formed on a lower portion of the spindle;

disposing a wafer carrier at least partially within the lower portion of the spindle, the wafer carrier having a convex spherical surface formed on a surface opposite the concave spherical surface of the spindle; and coupling the spindle to the wafer carrier using a drive cup disposed between the spindle and the wafer carrier, the drive cup having a concave inner surface and a convex outer surface, wherein the drive cup allows the wafer carrier for holding a wafer to be tilted about a predefined gimbal point when the wafer carrier is applied to a polishing pad.

20. A method as recited in claim 19, wherein the gimbal point is located on an interface between a polishing pad and a surface of a wafer held by the wafer carrier.

21. A method as recited in claim 19, wherein the gimbal point is located below an interface between a polishing pad and a surface of a wafer held by the wafer carrier.

22. A method as recited in claim 19, wherein the gimbal point is located above an interface between a polishing pad and a surface of a wafer held by the wafer carrier.

* * * * *